US005482468A

United States Patent [19]

Bolin

[11] Patent Number: 5,482,468

[45] Date of Patent: Jan. 9, 1996

[54] PLUG CONTACT

[75] Inventor: Mauritz Bolin, Dalarö, Sweden

[73] Assignee: Ingenjörsfirma Mauritz Bolin AB, Haninge, Sweden

[21] Appl. No.: 170,308

[22] PCT Filed: Jun. 3, 1992

[86] PCT No.: PCT/SE92/00380

§ 371 Date: Jan. 3, 1994

§ 102(e) Date: Jan. 3, 1994

[87] PCT Pub. No.: WO93/01633

PCT Pub. Date: Jan. 21, 1993

[30] Foreign Application Priority Data

Jul. 3, 1991 [SE] Sweden ..... 9102080

[51] Int. Cl.[6] ..... H01R 29/00

[52] U.S. Cl. ..... 439/172; 439/668

[58] Field of Search ..... 439/171–174, 439/217, 218, 660, 668

[56] References Cited

U.S. PATENT DOCUMENTS 4,239,320 12/1980 Hesse et al. ..... 439/171 X
4,626,052 12/1986 Rumble ..... 439/173
4,770,644 9/1988 Feder ..... 439/174 X
5,131,870 7/1992 El-Haj ..... 439/668
5,201,677 4/1993 Takayama ..... 439/668

OTHER PUBLICATIONS

IBM Technical Disclosure, vol. 11, No. 10, Mar. 1969.

*Primary Examiner*—Khiem Nguyen
*Attorney, Agent, or Firm*—Jacobson, Price, Holman & Stern

[57] ABSTRACT

A jack-type plug in the form of a connecting plug includes a central contact pin for one conductor and a resilient contact element in the region of the outside surface of the plug for the other conductor, the plug having an axially elongate male part for mating with a female part constituting a part of the current socket receiving the plug. To enable the same plug to be used for two differently dimensioned current sockets the male part in forming of two parts with different cross-sectional dimensions so that the one male part mates with the female part of a current socket and the other male part mates with the female part of another socket, this part having a different cross-sectional area from the first mentioned female part. In addition, the smaller male part carries the central contact pin and is movable in the larger male part, but no farther than to permit the pin to remain axially projecting outside the larger male part.

5 Claims, 3 Drawing Sheets

PLUG CONTACT

BACKGROUND OF THE INVENTION

The present invention relates to an electrical connector in the form of a jack-type socket plug including a central contact pin for one conductor and resilient contact elements in the region of the outer surface of the plug for the other conductor, the plug having an elongate male portion for mating with a female part of the current socket receiving the plug.

SUMMARY OF THE INVENTION

The object of the present invention is to provide a plug which can be used for two current sockets of different sizes without needing to use some form of adaptor or protector. It is namely usual with at least two different dimensions for jack-type current sockets receiving this kind of plug. It is customary in the automobile industry to use a socket having a certain diameter, while a socket where the receiving female part has a smaller diameter is used for marine purposes. This kind of current socket and plug is used together with radio apparatus, telephones and the like. Particularly with respect to radios and telephones it is impractical to have one type of plug, suiting the cigarette lighter socket, intended for using the instrument in a vehicle such as a car, while an other version of the plug is needed when the same instrument is to be used for marine purposes. The present invention solves the problem such that the same plug on the cord to the instrument can be used for current sockets having two different dimensions. The invention also ensures that the plug is a good fit in the female part of the current socket when used in either size of current socket. In addition, there is no need, as already mentioned, for an adaptor or protective sleeve or the like, which is customary at present, such means and devices being easily lost or forgotten when using the associated apparatus.

Characterizing for the invention and providing a solution to the problem is that the male part comprises two members with two different cross-sectional dimensions so that one male part mates with a current socket female part and the other male part mates with the female part of an other current socket having different cross-sectional dimensions than that of the first mentioned current socket female part, and in that the smaller male part carries the central contact pin and is movable in the larger male part, but no further than that the pin still projects out axially outside the larger male part, and such that by the movement the plug can be optionally mated to either of the two differently dimensioned current sockets.

An embodiment of the invention will now be described with reference to the accompanying drawing figures.

BRIEF DESCRIPTION OF DRAWINGS

FIG. 1 is a side view of the plug, while

DESCRIPTION OF PREFERRED EMBODIMENTS

Figure 1:
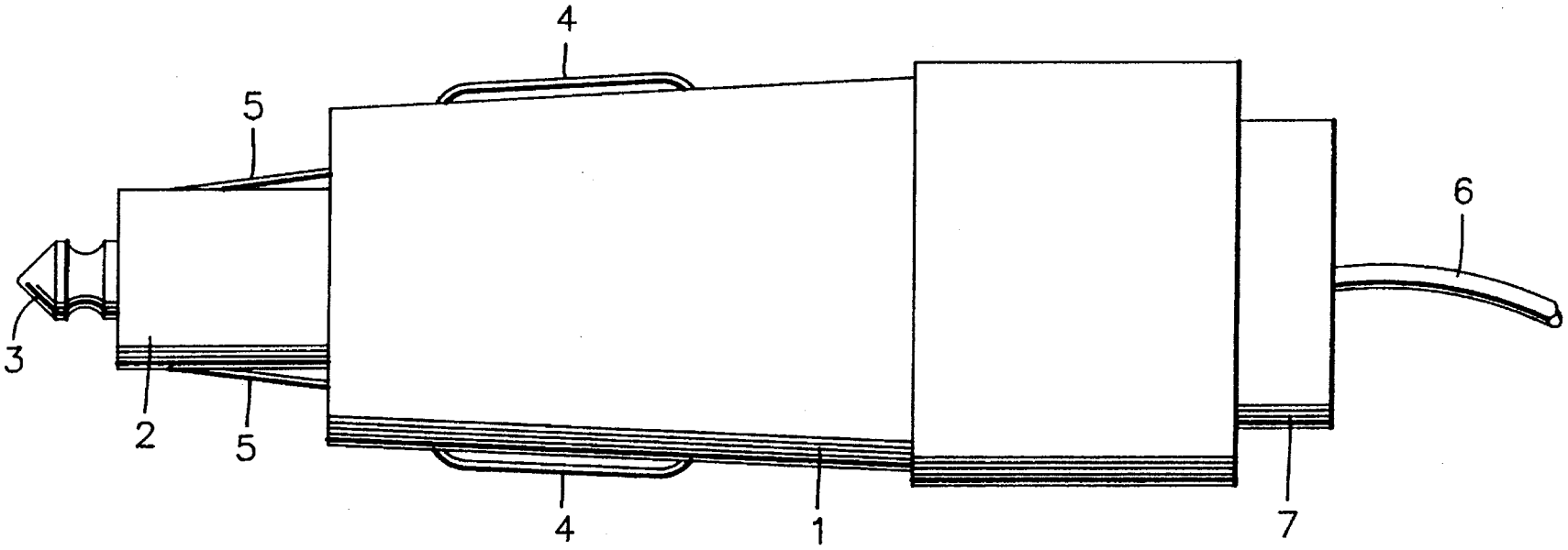

Turning now to FIG. 1, it will be seen that a hollow body 1 comprises a male part. A sleeve 2, axially displaceable in the body 1, constituting a male part of less cross-sectional dimensions than the corresponding dimensions for the body 1, is illustrated in an outwardly thrust position. The sleeve 2 can thus be thrust into the body 1 but only so far that a contact 3 mounted on the left-hand side (in the Figure) of the sleeve 2 is still free or projects out in front of the end of the body 1. The pin 3 is connected to the positive conductor of a cord 6. This connection takes place inside the body 1, see FIG. 2 and the text below. In the outer surface of both body 1 and sleeve 2 there is a contact element 4,5. In the interior of body 1 this element is connected to the other conductor of the cord 6, preferably its minus pole. When the plug is pushed into a female part of a small diameter the element portion 5 constitutes the contact means, while when the plug is thrust into a female part having a large diameter the element portion 4 serves as contact means. The pin 3 is always the positive means when the plug is inserted into a current socket. Accordingly, when the plug is to be used with a current socket having a small diameter the sleeve 2 is thrust out and only this sleeve together with the contact element portion 5 together with the pin 3 are inserted in the female part. The body 1 with the contact element portion 4 are outside the female part. When the plug is to be used for a socket having a large cross section with respect to its female part the sleeve 2 is thrust into the body 1 such that the left-hand end of the sleeve is flush with the left-hand end of the body 1, i.e. the pin 3 still projects out to the left in relation to the body 1. As the sleeve 2 is thrust inwards (to the right in the Figure), the element portion 4 also moves to the right and will coact with the corresponding contact portion of the socket female part. As will be seen from the Figure, the sleeve 2 extends through the entire body 1 so that with a simple hand movement, i.e. pushing or pulling the projecting part 7 to the right of the body 1, the sleeve can be manoeuvered or thrust into a desired position.

Figure 2:
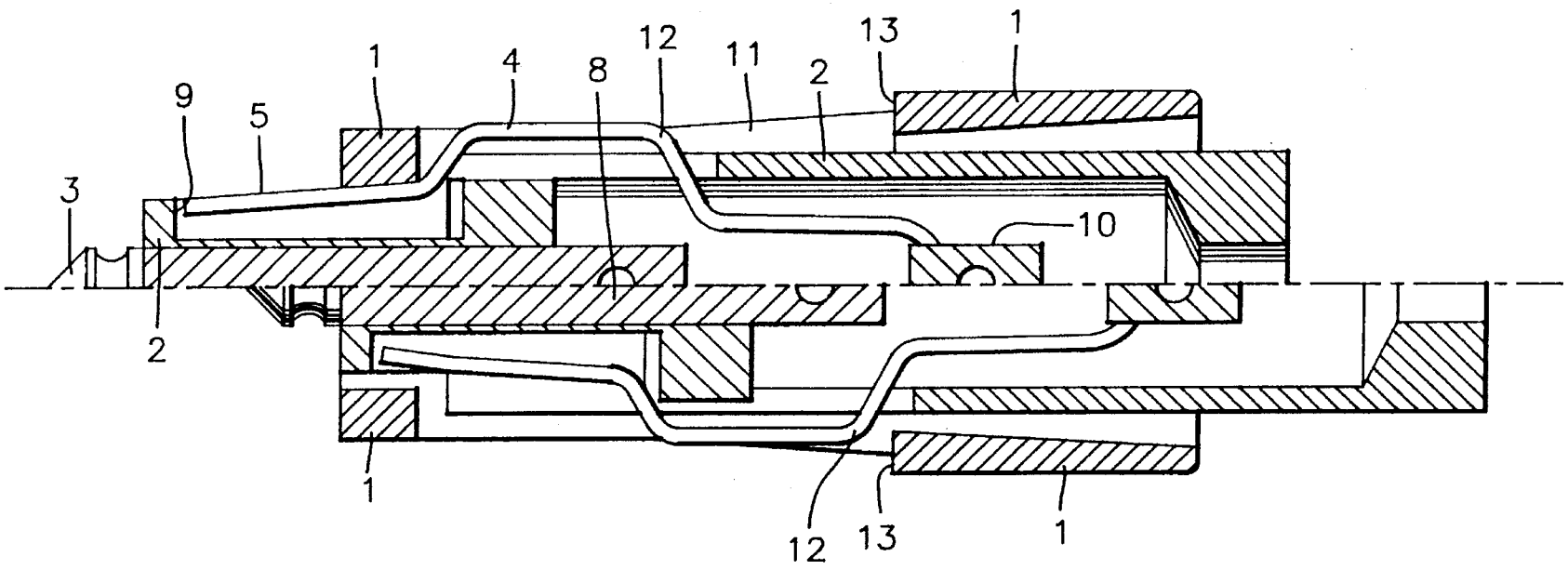
FIG. 2 is a longitudinal section through it with the smaller male part in different positions.

The plug is shown in more detail in FIG. 2. The upper half of the Figure is a longitudinal section where the sleeve 2 is thrust out to the left from the body 1. In the illustrated embodiment the pin 3 is elongate and inserted in an axial bore through the sleeve 2. The pin 3 is also carried resiliently such that it can be resiliently thrust into the sleeve 2, and at its inner end portion 8 it is firmly connected to the plus pole of the unillustrated cord 6. The element portion 4 merges into the free element; tung portion 5 extending out to the left, this portion being accomodated in a groove 9 in the sleeve 2. The right-hand end of the portion 4 is mounted on a portion 10 on the associated sleeve 2. The other unillustrated conducter is connected to the portion 10. It will be understood that when the sleeve 2 is moved to the right and to the left the element 4,5 accompanies it. The body 1 has a slot 11 in which the element portion 4 can move reciprocatingly when the sleeve 2 is moved reciprocatingly relative the body. The element portion 4 has a shoulder 12 at its right hand end, and this comes into engagement against the right-hand edge 13 of the groove 11 when the sleeve 2 is thrust in as far to the right as possible, which will be seen from the bottom half of FIG. 2.

As will be further seen from the Figure, the outside surface of the sleeve 2 tapers slightly, and the same applies to the outside surface of the body 1. As previously mentioned, when the sleeve 2 is in its outwardly thrust position the element portion 5 constitutes the contact surface to the mating surface of the corresponding female part, the pin 3 constituting the plus pole contact. When the sleeve 2 is thrust into the body 1, the element portion 4 will constitute the contact surface with the mating surface of a female part, the pin 3 still constituting the plus pole contact. This will be seen from the lower half of FIG. 2.

Figure 3:
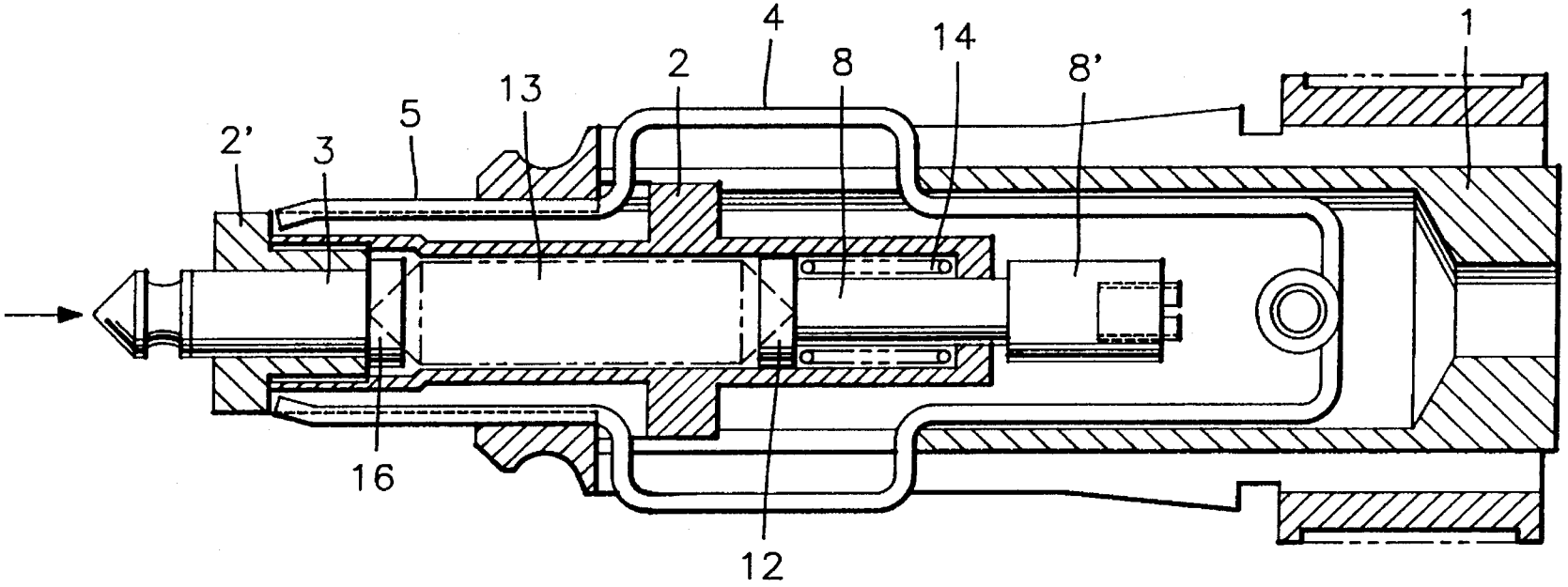
FIG. 3 illustrates the same parts as in FIG. 1 but with a fuse inserted.

In FIG. 3 there is illustrated another embodiment of the invention. The plug is illustrated in longitudinal section with the narrower male part 2,2' thrust outward. The pin 3 is movably arranged in a sleeve 2' which is threaded into the left-hand end of the narrower cylindrical sleeve portion 2. The contact pin is prevented from being thrust out from the sleeve 2' by a shoulder 16 on its inner end. Behind the pin 3 there is a fuse 13 in contact at the inner end with a pin 8 biased against it with the aid of a spring 14 one end of the spring bearing against the bottom of the sleeve 2 and its other end against a shoulder 12 on the left-hand end of the pin 8. The plus pole of the cord illustrated in FIG. 1 is attached to the right-hand end 8' of the pin 8. For changing the fuse, the sleeve portion 2' is screwed out together with the pin 3, so that the fuse can be taken out of the cylindrical sleeve portion 2.

In the illustrated embodiment it has been described how the sleeve 2 executes a purely axial motion in relation to the body 1. Of course, other forms of movement or combinations thereof can be envisaged, e.g. the sleeve 2 can be threaded to the body 1 so that the displacing movement is achieved by relative twisting. It should be observed that the plug is normally cylindrical but this is not a condition essential to the invention. This means that the outside surface of the plug is not necessarily cylindrical.

I claim:

1. An electrical connector in the form of a jack-type socket plug including a central contact pin for one conductor and a resilient contact element in the region of an outer surface of the plug for a second conductor, the plug having an axially extended male portion for mating with a female portion which is a part of a current socket for receiving the plug, the male portion comprising two parts having different cross-sectional dimensions so that a larger one of the male parts mate with the female part of one current socket and the other smaller male part mates with the female part of another current socket having different cross-sectional dimensions from the first-mentioned female part, the smaller male part carrying the central contact pin, wherein the smaller male part is movable in the larger male part, but no farther than to permit the central contact pin to remain projecting outwardly axially outside the larger male part, the movement thus enabling the plug to be optionally mated to both dissimilarly dimensioned current sockets, further characterized in that an element is axially fixed on an outer surface of the smaller male part and is displaceable relative the larger male part, and otherwise connects up to the outer surfaces of both male parts so that, they can resiliently move in from a position outside the respective outside surface to a position flush with said respective surface.

2. Plug as claimed in claim 1, characterized in that each of the male parts have tapering configuration.

3. Plug as claimed in claim 1, characterized in that the central contact pin is axially resiliently carried by the smaller male part.

4. Plug as claimed in claim 1, characterized in that the element is accommodated in an axially groove in the outer surface of the larger male part, and in that the larger male part has a shoulder limiting the motion of the element in the groove in a direction for thrusting in the smaller male part.

5. Plug as claimed in claim 3, characterized in that a fuse is situated between the contact pin and its resilient mounting means.

* * * * *